United States Patent [19]

Finkle

[11] Patent Number: 4,821,371

[45] Date of Patent: Apr. 18, 1989

[54] SAFETY HANDLE

[75] Inventor: Louis J. Finkle, Bellflower, Calif.

[73] Assignee: Larry K. Goodman, Cerritos, Calif.

[21] Appl. No.: 72,537

[22] Filed: Jul. 13, 1987

[51] Int. Cl.[4] ..... G05G 1/08

[52] U.S. Cl. ..... 16/112; 74/548

[58] Field of Search ..... 16/112, DIG. 12; 74/543, 548

[56] References Cited

U.S. PATENT DOCUMENTS 3,315,540 4/1967 Baumgartner ..... 74/548

FOREIGN PATENT DOCUMENTS 1338098 11/1973 United Kingdom ..... 74/543

*Primary Examiner*—M. Jordan
*Assistant Examiner*—Richard K. Seidel
*Attorney, Agent, or Firm*—Donald D. Mon

[57] ABSTRACT

A safety handle releasably drives a shaft which is also otherwise powered. The shaft has an axis of rotation and a peripheral engagement band. The safety handle has a frame including a bearing aperture receiving shaft so as to be freely rotatable on and relative to the shaft, a lever arm extending away from the bearing aperture, and pivot means laterally spaced from the aperture. Centering means resiliently bi-directionally biases the drive handle and engagement means towards the centralized position. When the drive handle is grasped and twisted around the handle axis, the engagement means is pivoted to engage the engagement band, enabling torque exerted on the drive handle relative to the shaft axis to turn the shaft, but when the twisting effort is released, the centering means returns the handle and the engagement means to the centralized position, thereby releasing the engagement means from the engagement band and freeing the safety handle for free rotation around and relative to the shaft. Preferably, the centering means comprises a pair of springingly resiliently flexible arms on the drive handle, each of which is opposed to a respective wall of the frame. Rotation of the drive handle around its axis in either direction is resisted by one of these arms.

8 Claims, 1 Drawing Sheet

FIG. 1
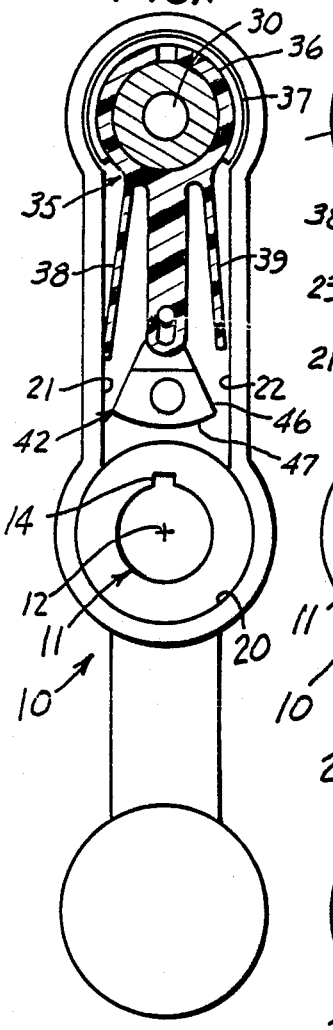
FIG. 2
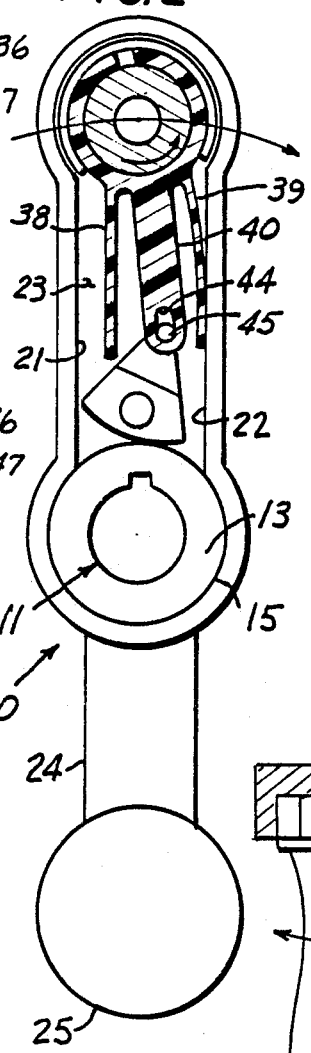
FIG. 4
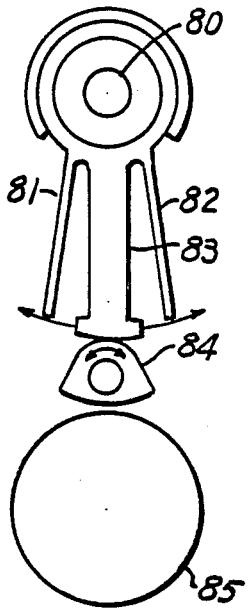
FIG. 5
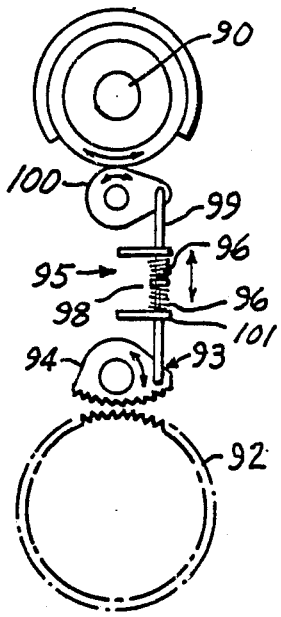
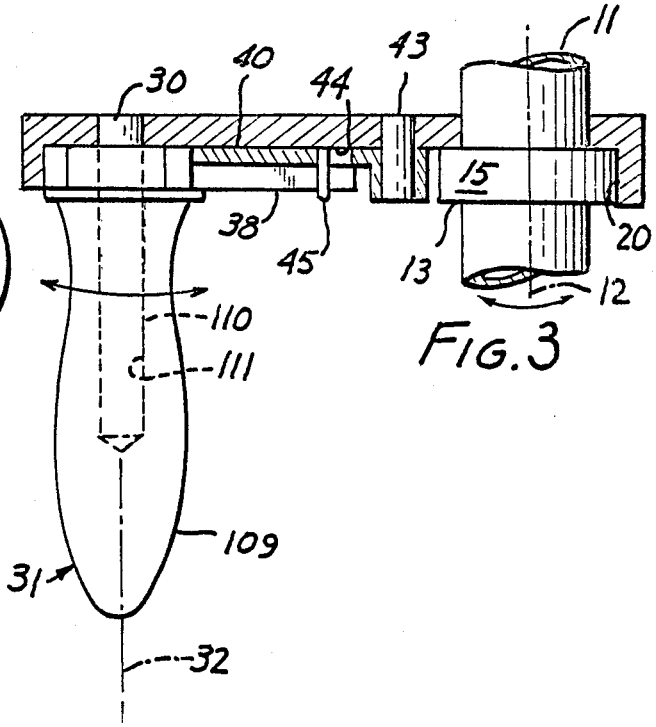
FIG. 3

SAFETY HANDLE

FIELD OF THE INVENTION

This invention relates to a safety handle which can releasably drive a shaft that is also otherwise powered. When the safety handle is released, it rotates freely on said shaft.

BACKGROUND OF THE INVENTION

Especially in the machine tool field, but not exclusively, it is an objective to provide a handle for manually turning a shaft, perhaps to move a tool saddle. It is conventional practice for this shaft also to be powered by another source such as an electrical or hydraulic motor. The problem which results is that unless the handle is specifically disengaged, it will turn when the shaft is driven by the other source. Then a person standing nearby may be struck or caught by the rotary handle, and be injured.

It is an object of this invention to provide a safety handle which can bi-directionally rotate a shaft, engaging the shaft while so doing. But when the safety handle is released, it will automatically be disengaged from the shaft and rotate freely relative to it. Bystanders cannot then be struck by it, because it will not be turning, or if it is, it will be freely turning and will immediately stop if it encounters any resistance.

Because this is a safety device, it is necessary for its disengagement to be automatic, without requiring anything more than for the operator to let go of it. Because it should also be a convenient device to use, it should require no special exertion, or any manipulation not ordinarily expected to be exerted to turn a handle.

According to this invention, the twisting torque exerted on any handle to turn it will also be sufficient to cause driving engagement with the shaft, and the release of this torque will result in prompt disengagement.

BRIEF DESCRIPTION OF THE INVENTION

A safety handle according to this invention releasably drives a shaft which is also otherwise powered. The shaft has an axis of rotation and a peripheral engagement band. The safety handle has a frame including a bearing aperture receiving said shaft so as to be freely rotatable on and relative to the shaft, a lever arm extending away from said bearing aperture, and pivot means laterally spaced from said aperture.

A drive handle is bi-directionally rotatably mounted to said pivot means, this handle having a handle axis of rotation extending parallel to the axis of said shaft. Engagement means is pivotally mounted to said frame and is rotatable by said drive handle, the engagement means thereby being bi-directionally rotatable and having an engagement surface conformed to stand away from said engagement band in a centralized position, and to engage said engagement band when substantially rotated in either direction from said centralized position. Centering means resiliently bi-directionally biases the drive handle and engagement means toward the centralized position. When said drive handle is grasped and twisted around the handle axis, the engagement means is pivoted to engage the engagement band, enabling torque exerted on the drive handle relative to said shaft axis to turn said shaft, but when the twisting effort is released, the centering means returns the handle and the engagement means to the centralized position, thereby releasing the engagement means from the engagement band and freeing the safety handle for free rotation around and relative to the shaft.

According to a preferred but optional feature of the invention, the centering means comprises a pair of springingly resiliently flexible arms on the drive handle, each of which is opposed to a respective wall of the frame. Rotation of the drive handle around its axis in either direction is resisted by a respective one of these arms.

The above and other features of this invention will be fully understood from the following detailed description and the accompanying drawings, in which:

BRIEF DESCRIPTION OF THE DRAWINGS

FIG. 1 is a side elevation, partly in cutaway cross-section, showing the presently preferred embodiment of the invention in a centralized, freely rotatable condition;

FIG. 2 is a view similar to FIG.1 showing the invention in a drawing condition;

FIG. 3 is a side view partly in cutaway cross-section of the device of FIG. 1; and FIGS. 4 and 5 are partially schematic fragmentary views of other embodiments of the invention.

DETAILED DESCRIPTION OF THE INVENTION

A safety handle 10 according to the invention is shown mounted to a shaft 11. Shaft 11 has a central axis of rotation 12, around which it can be bi-directionally driven, selectively, by the safety handle and by other power means (not shown) such as an electrical or hydraulic motor. A collar 13 is keyed to the shaft by key 14 so as to turn with it. An engagement band 15, in the form of a peripheral cylindrical surface, is formed on the collar.

Safety handle 10 includes a bearing aperture 20 fitted on the engagement band. The frame also includes a pair of walls 21, 22, a housing portion 23, a counterweight arm 24, and a counterweight 25.

Pivot means 30, in this example a cylindrical pin, mounts a drive handle 31 which projects from one side of the frame. The drive handle has a drive handle axis 32 that is parallel to shaft axis 12, and is laterally spaced from it. Drive handle 31 is freely rotatable around the pivot means.

Centering means 35 fits tightly onto the drive handle so as to turn with it, and is in effect a continuation of the drive handle. As best shown in FIG. 1, the centering means has a clamp fitted over boss 36, and is retained by a retainer 37. Two springingly resilient flexible arms 38, 39 extend away from the pivot means, and branch apart from one another so their ends bear against walls 21, 22 to bias the handle toward the centralized position shown in FIG. 1.

A lever 40 between arms 38 and 39 extends from the drive handle to connect to engagement means 42. Engagement means 42 is pivotally mounted to the frame by pin 43. A slot 44 receives a tang 45 so that rocking (pivoting) movement of the lever will rock cam 46. Cam 46 has an engagement face 47 which is curved so as to be spaced from engagement band 15 when in the centralized position, and to engage it when in an off-central position such as shown in FIG. 2. Face 47 and band 15 may be surfaced with fricitional material, or even made roughened or serrated to encourage the engagement once it is made.

It will now be seen that turning the drive handle around its own axis against the bias resistance of the arms will cause the engagement means to engage the safety handle to the shaft. Then, maintaining this angular displacement, which will be done merely by gripping the drive handle tightly enough, while still letting it rotate relative to the handle, the drive handle can be torqued around axis 12 in the respective direction. When the drive handle is released, the bias means returns the safety handle to the centralized position, whereupon the shaft and safety handle are rotationally free of one another.

FIG. 4 illustrates another embodiment of the invention. Drive handle 80 includes a pair of resiliently flexible arms 81, 82 as in FIG. 1, and a central lever 83. Engagement means 84 are pivotally mounted to the frame, also as before. The frame is mounted to a shaft 85 as before. However, instead of a pin-slot interconnection, the engagement means and lever are suitably surfaced such as by frictional material or teeth so that rocking the lever also rocks the engagement means. Apart from this interface, the shape and function are the same as in FIG. 1.

FIG. 5 illustrates yet another embodiment of the device. As before, a drive handle 90 is rotatably mounted to a frame, and the frame is rotatably fitted to a shaft 92 all as before. Engagement means 93 includes a cam 94 as in the other embodiments. However, this drive handle does not include the two arms. Instead, centering means 95 comprises two compression springs 96, 97 opposed to each other through a collar 98 on a link rod 99. Shoulders 100, 101 on the frame (not shown) compress the springs. Thus, the link rod is biased bi-directionally to a centralized position. An eccentric 100 is rotatably mounted to the frame and is engaged to the drive handle so that it and the engagement means rotate together to engage or disengage with the shaft. The driving function is the same as in the other embodiments.

In the previous description, the surface 109 of handle 31 is gripped to twist the drive handles while an operative torque is also exerted on the safety handle. This required that surface 109 slip along the skin of the hand. In effect, the hand and the handle exerted a slipping drag on the surface of the handle, while the hand exerted a torque around the axis of the shaft. If the drag along the skin is not desirable, it can instead be built into the handle. As shown in phantom lines, shaft 110 can be provided as an extension of the centering means. Then the handle 31 itself is provided with a socket having a matching cylindrical surface 111 such that the handle can be turned relative to shaft 110, but with a frictional drag between them. Surface 111 and the periphery of shaft 110 thereby constitute "drag means". Now the handle need not slip in the hand. The slippage occurs internally between 110 and 111. This is a convenience, but not a necessity.

The invention thereby provides a safety handle which engages as the consequence of a normal grip and applied torque, and disengages when the torque is released.

This invention is not to be limited by the embodiments shown in the drawings and described in the description, which are given by way of example and not of limitation, but only in accordance with the scope of the appended claims.

I claim:

1. A safety handle for releasably driving a shaft which is also otherwise powered, said shaft having an axis of rotation and a peripheral engagement band, and said safety handle comprising:

a frame including a bearing aperture receiving said shaft so as to be freely rotatable on and relative to the shaft, a lever arm extending away from said bearing aperture, and pivot means laterally spaced from said aperture;

a drive handle bi-directionally rotatably mounted to said pivot means, said handle having a handle axis of rotation extending parallel to the axis of said shaft;

engagement means pivotal mounted to said frame and rotatable by said drive handle, said engagement means thereby being bi-directionally rotatable and having an engagement surface conformed to stand away from said engagement band when substantially rotated in either direction from said centralized position; and centering means resiliently bi-directionally biasing said drive handle and engagement means toward said centralized position, whereby when said drive handle is grasped and twisted around said handle axis, said engagement means is pivoted to engage said engagement band, enabling torque exerted on said drive handle relative to said shaft axis to turn said shaft, but when said twisting effort is released, said centering means returns said handle and said engagement means to said centralized position, thereby to release said engagement means from said engagement band and freeing said safety handle for free rotation around and relative to said shaft, said centering means comprises a pair of springingly resiliently flexible arms on said drive handle, each opposed to a respective wall of said frame, rotation of said handle in either direction around its axis being resisted by a respective one of said flexible arms.

2. A safety handle according to claim 1 in which said drive handle includes a lever pinned to said engagement means to rotate said engagement means when the drive handle is turned around its own axis.

3. A safety handle according to claim 2 in which said engagement means comprises a cam, said engagement surface forming a face thereof whose spacing from said shaft is at a maximum in said centralized position, and at a minimum when rotated from said centralized position.

4. A safety handle according to claim 2 in which said lever is connected to said engagement means by a pin slidably fitted in a slot in said engagement means.

5. A safety handle according to claim 2 in which said lever is driveningly engaged to said engagement means by rolling contact.

6. A safety handle according to claim 1 in which said frame carries a counterweight on the opposite side of the shaft axis from said drive handle.

7. A safety handle according to claim 1 in which rotary drag means is provided in said drive handle to enable said handle to rotate relative to said engagement means, but with a resistive drag.

8. A safety handle for releasably driving a shaft which is also otherwise powered, said shaft having an axis of rotation and a peripheral engagement band, and said safety handle comprising:

a frame including a bearing aperture receiving said shaft so as to be freely rotatable on and relative to the shaft, a lever arm extending away from said bearing aperture, and pivot means laterally spaced from said aperture;

a drive handle bi-directionally rotatably mounted to said pivot means, said handle having a handle axis of rotation extending parallel to the axis of said shaft;

engagement means pivotally mounted to said frame and rotatable by said drive handle, said engagement means thereby being bi-directionally rotatable and having an engagement surface conformed to stand away from said engagement band in a centralized position, and to engage said engagement band when substantially rotated in either direction from said centralized position;

centering means reisiliently bi-directionally biasing said drive handle and engagement means toward said centralized position, whereby when said drive handle is grasped and twisted around said handle axis, said engagement means is pivoted to engage said engagement band, enabling torque exerted on said drive handle relative to said shaft axis to turn said shaft, but when said twisting effort is released, said centering means returns said handle and said engagement means to said centralized position, thereby to release said engagement means from said engagement band and freeing said safety handle for free rotation around and relative to said shaft; and a crank rod linkage joining said drive handle to said engagement means, and a pair of opposed springs operative on said linkage tending to center said engagement means.

* * * * *